US005585024A

United States Patent [19]

Kosugi

[11] Patent Number: 5,585,024

[45] Date of Patent: Dec. 17, 1996

[54] PROTECTING DEVICE FOR PROTECTING AN ELECTRONIC EQUIPMENT IN ORDER TO USE THE ELECTRONIC EQUIPMENT UNDER A HOSTILE ENVIRONMENT

[75] Inventor: Yuhei Kosugi, Tokyo, Japan

[73] Assignee: NEC Corporation, Japan

[21] Appl. No.: 419,913

[22] Filed: Apr. 11, 1995

[30] Foreign Application Priority Data

Apr. 14, 1994 [JP] Japan ..... 6-100588

[51] Int. Cl.[6] ..... H05B 1/02

[52] U.S. Cl. ..... 219/494; 219/209; 219/491; 174/52.1; 361/692; 361/690; 165/80.3

[58] Field of Search ..... 219/494, 497, 219/209, 210, 512, 491, 490; 236/1, 49; 174/52.1; 361/688, 689, 690, 692, 695; 165/80.3, 122

[56] References Cited

U.S. PATENT DOCUMENTS

| | | | |
|---|---|---|---|
| 2,380,026 | 7/1945 | Clarke | 361/695 |
| 4,107,941 | 8/1978 | Hamilton | 62/186 |
| 4,206,804 | 6/1980 | Scholtes et al. | 165/40 |
| 4,705,928 | 11/1987 | Nakanishi | 219/757 |
| 4,839,486 | 6/1989 | Tanigawa | 219/10.55 R |
| 4,949,218 | 8/1990 | Blanchard et al. | 361/384 |
| 5,221,811 | 6/1993 | Seldin | 174/52.1 |

*Primary Examiner*—Mark H. Paschall

*Attorney, Agent, or Firm*—Ostrolenk, Faber, Gerb & Soffen, LLP

[57] ABSTRACT

A protecting device is for use in protecting a radio communication device (15) under high and low temperature. The protecting device comprises a cover member (31) of a heat insulator that defines a room therein. The radio communication device is located in the room. First and second opening portions (31*a*, 31*b*) are formed at the cover member. The first opening portion may be opposite to the second opening portion. Each of the first and the second opening portions has a predetermined opening area. The protecting device further comprises first and second damper members (32*a*, 32*b*) and has first and second driving sections (33*a*, 33*b*, 34*a*, 34*b*). The first driving section drives the first damper member in accordance with a room temperature to make the first damper member vary the predetermined opening area into a variable opening area in the first opening portion. The variable opening area is smaller than the predetermined opening area. Similarly, the second driving section drives the second damper member in accordance with the room temperature to make the second damper member vary the predetermined opening area into the variable opening area in the second opening area.

10 Claims, 3 Drawing Sheets

PROTECTING DEVICE FOR PROTECTING AN ELECTRONIC EQUIPMENT IN ORDER TO USE THE ELECTRONIC EQUIPMENT UNDER A HOSTILE ENVIRONMENT

BACKGROUND OF THE INVENTION

This invention relates to a protecting device for protecting electronic equipment in order to use the electronic equipment hostile environment.

It is to be noted throughout the instant specification that a radio communication apparatus will be mainly described as an example of the electronic equipment hereinunder although this invention is not restricted to the radio communication apparatus.

The radio communication apparatus comprises a radio communication device and an antenna device which is connected to the radio communication device. The radio communication device may be connected to the antenna device through a transmission path which has a propagation loss. The transmission path may be, for example, a cable. In order to decrease the propagation loss, it is necessary to shorten the length of the transmission path. In order to shorten the length of the transmission path, it is desirable that the radio communication device is located near the antenna device. This means to locate the radio communication device outside a house.

When the radio communication device is located outside the house, the radio communication device is subjected to a hostile environment, for example, rain, snow, dust, salt damage, high temperature, and low temperature. As a result, it is necessary to make the radio communication device be weatherproof. In order to make the radio communication device be weatherproof, a protecting device is generally used which is for protecting the radio communication device under the hostile environment. More particularly, the protecting device is for use in protecting the radio communication device under the high temperature and the low temperature.

A first conventional protecting device comprises a shelter having a radome. The radio communication apparatus is located in the shelter. An air conditioner may be located in the shelter in order to keep a room temperature within the shelter at a predetermined temperature.

A second conventional protecting device comprises a heater attached on the radio communication device. When the atmospheric temperature becomes a low temperature, the radio communication device is heated by the heater so that the radio communication device is kept at a predetermined temperature range.

A third conventional protecting device comprises a heat insulator for covering the radio communication device in order to protect the radio communication device under a low atmospheric temperature. The radio communication device may have cooling fins for radiating the heat generated in the radio communication device.

However, the first conventional protecting device becomes a very high cost inasmuch as the first conventional protecting device comprises the shelter. Furthermore, consumption increases in electric power on using the first conventional protecting device because the air conditioner controls the room temperature within the shelter to the predetermined temperature.

The radio communication device having the second conventional protecting device is directly affected by the atmosphere around the radio communication device. For example, the radio communication device is directly affected by the wind. As a result, radiation of heat increases at the radio communication device as the wind becomes fresh. Consumption increases in electric power on using the second conventional protecting device under a strong wind.

It is to be noted that it is unnecessary to use the third conventional protecting device except for a hard winter season inasmuch as the third conventional protecting device comprises the heat insulator for covering the radio communication device. Namely, it is necessary to detach the heat insulator from the radio communication device except for the hard winter season.

SUMMARY OF THE INVENTION

It is therefore an object of this invention to provide a protecting device capable of reducing consumption of electric power.

It is another object of this invention to provide a protecting device of a low cost.

It is still another object of this invention to provide a protecting device capable of being used over all seasons.

Other objects of this invention will become clear as the description proceeds.

On describing the gist of this invention, it is possible to understand that a protecting device is for protecting electronic equipment. The protecting device comprises a covering member having at least one opening portion for covering the electronic equipment. The opening portion has a predetermined opening area. The protecting area further comprises area varying means responsive to a room temperature of the covering member for varying the predetermined opening area into a variable opening area which is smaller than the predetermined opening area.

DESCRIPTION OF THE PREFERRED EMBODIMENT

Figure 1:
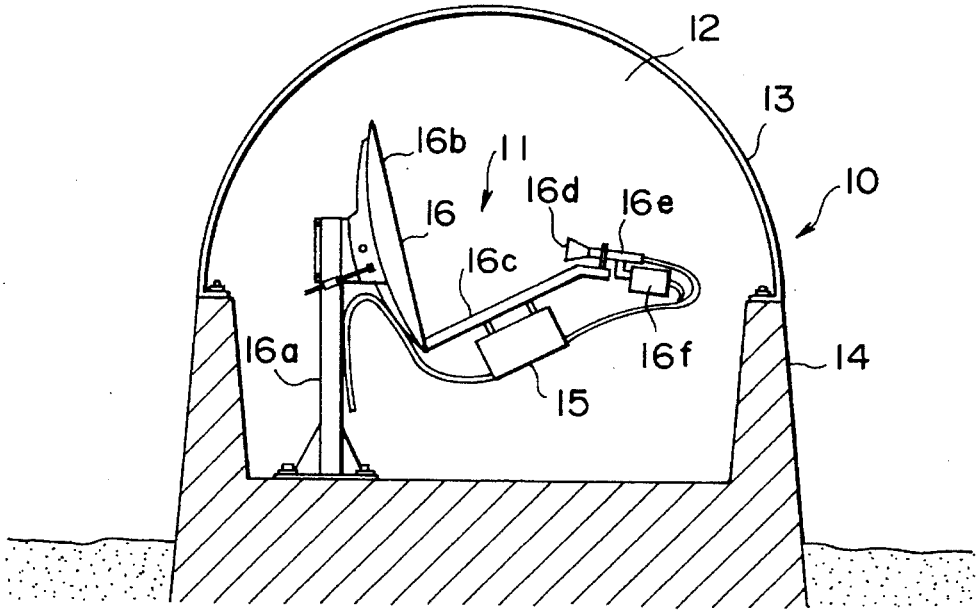
FIG. 1 PRIOR ART
FIG. 1 shows a sectional view of a first conventional protecting device.

Referring to FIG. 1, a first conventional protecting device will be described at first in order to facilitate an understanding of this invention. The illustrated protecting device 10 is for protecting an electronic equipment under a hostile environment. More particularly, the protecting device 10 is for use in protecting a radio communication apparatus 11 under high and low temperatures.

The protecting device 10 comprises a shelter 12 having a radome 13 and a pedestal 14. The pedestal 14 is located on the ground. The radio communication apparatus 11 is located on the pedestal 14. The radome 13 is fixed on the pedestal 14 so as to cover the radio communication apparatus 11.

The radio communication apparatus 11 comprises a radio communication device 15 and an antenna member 16. The radio communication device 15 may be operable between a high operable temperature and a low operable temperature. The high operable temperature may be, for example, 50° C. The low operable temperature may be, for example, −30° C. More specifically, the antenna member 16 comprises an antenna pole 16*a* which is fixed on the pedestal 14 and which is directed upwardly of FIG. 1. The antenna pole 16*a* supports an antenna reflector plate 16*b* on which a supporting member 16*c* is attached. A primary radiator 16*d* is attached on one end of the supporting member 16*c*. The primary radiator 16*d* is opposite to the antenna reflector plate 16*b*. The radio communication device 15 is supported by the supporting member 16*c*. The primary radiator 16*d* is coupled to a branching filter 16*e* which has transmission and reception ports. The radio communication device 15 is connected to the transmission port of the branching filter 16*e*. Furthermore, the radio communication device 15 is connected to the reception port of the branching filter 16*e* through a reception amplifier 16*f*.

Although illustration is not made in FIG. 1, a heating device may be located in the shelter 12. The heating device may be controlled by a control device. When the atmospheric temperature lowers and reaches a low temperature in the hard winter season, the control device controls the heating device to make the heating device heat the air in the shelter 12. The heating device prevents a room temperature of the shelter 12 from reaching a temperature which is less than high operable temperature.

The protecting device 10 may include a ventilating arrangement (not shown) in order to ventilate the room defined in the shelter 12 in the summer season. The ventilating arrangement prevents the room temperature of the shelter 12 from reaching a temperature which is greater than the high operable temperature. The protecting device 10 may include an air conditioner for air conditioning the room within the shelter 12 instead of the heating device and the ventilating arrangement.

As described above, the protecting device 10 is expensive because the protecting device 10 comprises the shelter 12. Furthermore, consumption increases in electric power because the heating device heats the whole room defined in the shelter 12.

Figure 2:
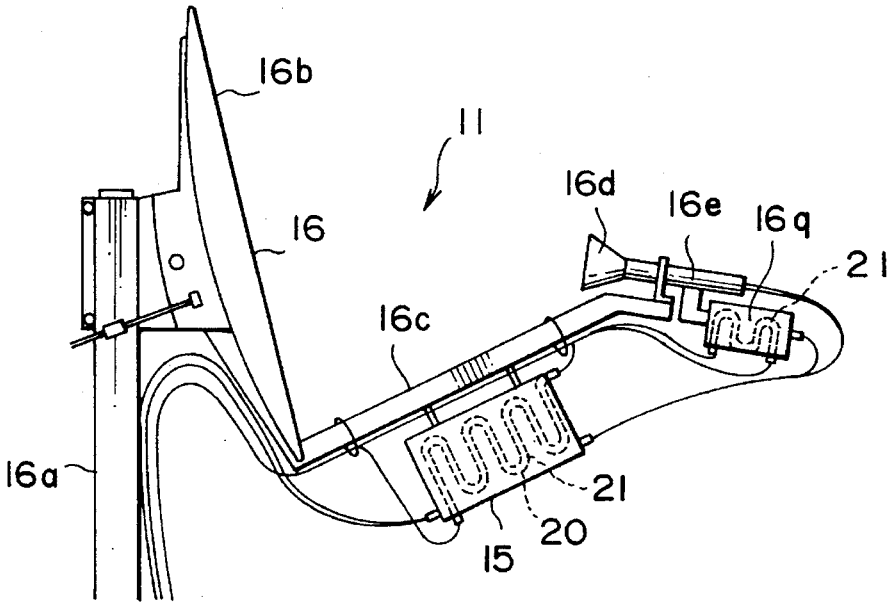
FIG. 2 PRIOR ART
FIG. 2 shows a sectional view of a second conventional protecting device.

Referring to FIG. 2, description will proceed to a second conventional protecting device. The illustrated protecting device is different in structure from the protecting device 10 illustrated in FIG. 1 and therefore designated afresh by a reference numeral 20. The protecting device 20 comprises a heater 21 and a power control circuit (not shown) for controlling supply of current to the heater 21. The protecting device is for use in protecting the radio communication device 15.

The heater 21 is located in the radio communication device 15. An additional heater 22 may be located in the reception amplifier 16*f*. In the example being illustrated, the heater 21 is connected to the additional heater 22 in series. When the atmospheric temperature is low, the power control circuit supplies the current to the heater 21 and the additional heater 22 to heat the radio communication device 15 and the reception amplifier 16*f*. As a result, each of the radio communication device 15 and the reception amplifier 16*f* is kept at an operating temperature greater than a temperature at which each of the radio communication device 15 and the reception amplifier 16*f* is operable.

As readily understood from the above-mentioned application, the radio communication device 15 is directly affected by the atmosphere around the radio communication device. For example, the radio communication device 15 is directly affected by wind. Radiation of heat increases at the radio communication device 15 as the wind becomes fresh. When the radio communication device 15 is kept at the operating temperature under the strong wind, consumption increases in the electric power because the heater 15 radiates a very much heat.

Figure 3:
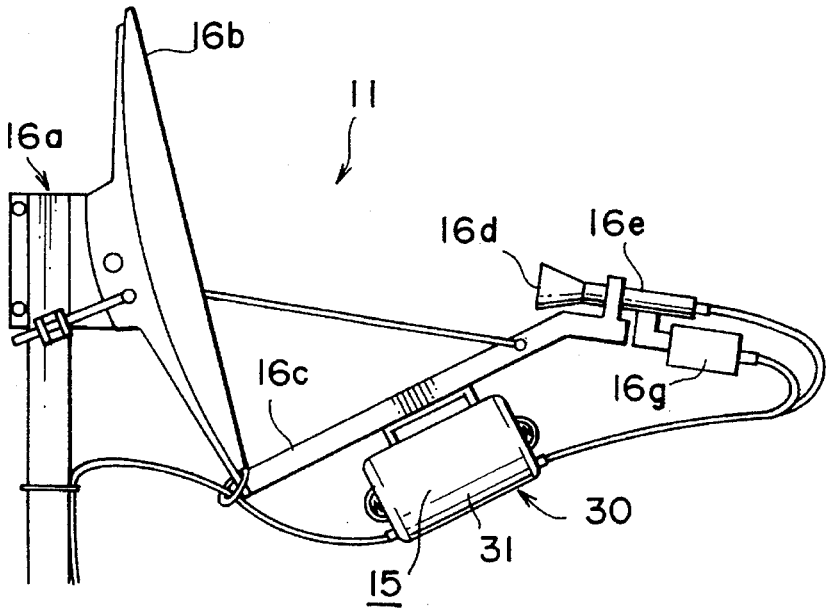
FIG. 3 shows a view for illustrating a radio communication apparatus having the protecting device according to a preferred embodiment of this invention.

Referring to FIG. 3, description will proceed to a protecting device according to a preferred embodiment of this invention. The illustrated protecting device is different in structure from the protecting devices 10 and 20 illustrated in FIGS. 1 and 2, respectively. Therefore, the protecting device is designated afresh by a reference numeral 30. The protecting device 30 is for use in protecting the radio communication device 15.

The protecting device 30 comprises a cover member 31 in heat insulator. The cover member 31 is for use in covering the radio communication device 15. Namely, the cover member 31 defines a room in which the radio communication device 15 is located. The temperature in the room will be called a room temperature hereinunder. The radio communication device 15 has a flange member 15*a* which is fixed on the supporting member 16*c* by bolts 151 and 152.

Figure 4:
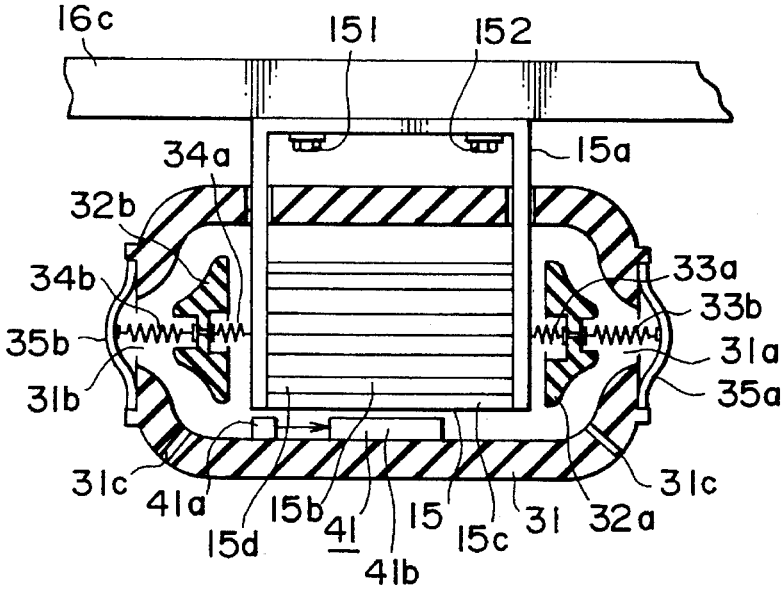
FIG. 4 shows a sectional view of the protecting device illustrated in FIG. 3.

Referring to FIG. 4, the cover member 31 has a cylindrical shape and is made of expanded plastics. Namely, the cover member 31 is composed of a heat insulator. The radio communication device 15 has a device housing 15*b* having a sealing structure of a high weatherproof. The device housing 15*b* comprises a main body 15*c* and the flange member 15*a* which is attached to the main body 15*c*. The main body 15*c* has cooling fins 15*d* for radiating heat from the radio communication device 15.

As described above, the radio communication device 15 is covered by the cover member 31. The cover member 31 may have first and second portions. On covering the radio communication device 15 by the cover member 31, the first portion is combined to the second portion to form the cover member 31 with positioning the radio communication device 15 in the cover member 31. When the radio communication device 15 is covered by the cover member 31, the flange member 15*a* is located outside the cover member 31.

The cover member 31 has at least one opening portion. In the illustrated example, first and second opening portions 31*a* and 31*b* are formed at the cover member 31. The first opening portion 31*a* is formed at the left end portion of the cover member 31 in FIG. 4. The second opening portion 31*b* is formed at the right end portion of the cover member 31 in FIG. 4. Furthermore, a plurality of drain holes 31*c* are formed at the cover member 31. More particularly, the drain holes 31*c* are formed at the bottom of the cover member 31 as shown in FIG. 3.

The protecting device 30 further comprises first and second damper members 32*a* and 32*b*. The first and the second damper members 32*a* and 32*b* are for use in closing the first and the second opening portions 31*a* and 31*b*, respectively. Each of the first and the second damper members 32*a* and 32*b* has a mountain-shaped section. The first damper member 32*a* is supported by a first shape memory alloy spring 33*a* and a first spring 33*b* of non-shape memory alloy. Similarly, the second damper member 32*b* is supported by a second shape memory alloy spring 34*a* and a second spring 34*b* of non-shape memory alloy. Each of the first and the second shape memory alloy springs 33*a* and 34*a* may be composed of TiNi.

A first supporting element 35*a* is attached on the cover member 31 so as to be laid across the first opening portion 31*a*. The first spring 33*b* is located between the first supporting element 35*a* and a front surface of the first damper member 32*a*. The first shape memory alloy spring 33*a* is located between a rear surface of the first damper member 33*a* and the device housing 15*d*. More particularly, one end of the first spring 33*b* is connected to the first supporting element 35*a*. Another end of the first spring 33*b* is connected to the front surface of the first damper member 32*a*. One end of the first shape memory alloy spring 33*a* is connected to the rear surface of the first damper member 33*a*. Another end of the first shape memory alloy spring 33*a* is connected to the device housing 15*d*.

Similarly, a second supporting element 35*b* is attached on the cover member 31 so as to be laid across the second opening portion 31*b*. The second spring 34*b* is located between the second supporting element 35*b* and a front surface of the second damper member 32*b*. The second shape memory alloy spring 34*a* is located between a rear surface of the second damper member 33*b* and the device housing 15*d*. More particularly, one end of the second spring 34*b* is connected to the second supporting element 35*b*. Another end of the second spring 34*b* is connected to the front surface of the second damper member 32*b*. Open end of the second shape memory alloy spring 34*a* is connected to the rear surface of the second damper member 33*b*. Another end of the second shape memory alloy spring 34*a* is connected to the device housing 15*d*.

In the example being illustrated, each of the first and the second shape memory alloy springs 33*a* and 34*a* extends along a predetermined direction parallel to its spring axis under a low temperature. Each of the first and the second shape memory alloy springs 33*a* and 34*a* shrinks along the predetermined direction under a high temperature. Namely, each of the first and the second shape memory alloy springs 33*a* and 34*a* has a variable tensile strength or force which is variable in accordance with the room temperature. In each of the first and the second shape memory alloy springs 33*a* and 34*a*, the variable tensile strength becomes weak as the atmospheric temperature becomes low. On the other hand, each of the first and the second springs 33*b* and 34*b* has a predetermined tensile strength independent from temperature.

Figure 5:
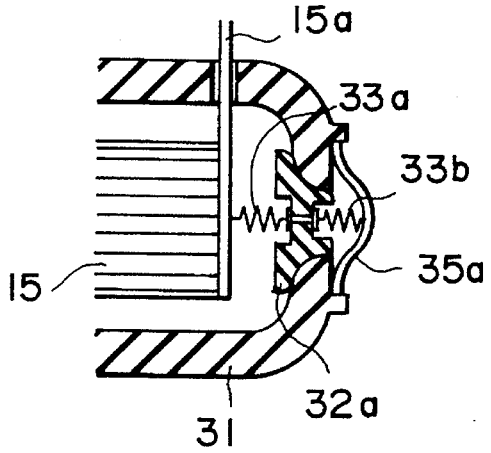
FIG. 5 shows a partial sectional view for describing operation of a damper member illustrated in FIG. 4.

Referring to FIG. 5 in addition to FIG. 4, attention will be directed to the first damper member 32*a*. The first shape memory alloy spring 33*a* extends along the predetermined direction as the room temperature becomes low. As a result, the first damper member 32*a* moves or shifts to a right side of FIG. 4 as will be described later. When the atmospheric temperature lowers to a predetermined low temperature, the first damper member 32*a* closes the first opening portion 31*a*. The predetermined low temperature may be equal to the low operable temperature.

It will be assumed that the first opening portion 31*a* has a first opening area at a predetermined high temperature, for example, 0° C. As readily understood from the above description, the first opening area is varied into a first variable opening area as the first damper member 32*a* moves the right side of FIG. 4. The first variable opening area is smaller than the first opening area, When the room temperature becomes the predetermined low temperature which may be, for example, −30° C., the first variable opening area becomes zero area as shown in FIG. 5.

Similarly, the second shape memory alloy spring 34*a* extends along the predetermined direction as the room temperature becomes low. As a result, the second damper member 32*b* moves to a left side of FIG. 4. When the room temperature lowers to the predetermined low temperature, the second damper member 32*b* closes the second opening portion 31*b* although illustration is not made in FIG. 5.

It will be assumed that the second opening portion 31*b* has a second opening area at the predetermined high temperature. The second opening area is varied into a second variable opening area as the second damper member 32*b* moves the right side of FIG. 4. The second variable opening area is smaller than the second opening area. When the room temperature becomes the predetermined low temperature, the second variable opening area becomes zero area. The first opening area may be equal to the second opening area.

Again referring to FIG. 4, the first and the second opening portions 31*a* and 31*b* has the first and the second opening areas, respectively, when the room temperature is greater than the predetermined high temperature. When the room temperature is not less than the predetermined high temperature, much outside air is introduced from one of the first and the second opening portions 31*a* and 31*b* because the first and the second opening portions 31*a* and 31*b* has the first and the second opening areas, respectively. The air in the cover member 31 is exhausted from another one of the first and the second opening portions 31*a* and 31*b*. As a result, it is possible to effectively radiate the heat from the radio communication device 15 to the outside of the cover member 31. The room temperature becomes near to the atmospheric temperature.

When the room temperature begins to lower from the predetermined high temperature, the tensile strength gradually becomes weak in each of the first and the second shape memory alloy springs 33*a* and 34*a*. The first damper member 32*a* is gradually pulled against the tensile strength of the first shape memory alloy spring 33*a* towards the right side of FIG. 4 by tensile strength of the first spring 33*b* as the room temperature is lower and lower.

Similarly, the second damper member 32*b* is gradually pulled against the tensile strength of the second shape memory alloy spring 34*a* towards the left side of FIG. 4 by tensile strength of the second spring 34*b* as the room temperature is lower and lower.

The first and the second opening portions 31*a* and 31*b* are gradually closed by the first and the second damper members 32*a* and 32*b*, respectively, as the first and the second damper members 32*a* and 32*b* move towards the right and the left sides of FIG. 4, respectively. The first and the second opening areas are varied into the first and the second variable opening areas. As a result, decrease occurs in the introduction amount of the outside air. Accordingly, radiation of heat decreases at the first and the second opening portions 31*a* and 31*b*. The room temperature is higher than the atmospheric temperature.

When room temperature further lowers to reach the predetermined low temperature, the first and the second damper members 32*a* and 32*b* close the first and the second opening portions 31*a* and 31*b*, respectively. The outside air is hardly introduced into the cover member 31. As a result, it is possible to prevent the heat from being radiating from the cover member 31. Namely, the room temperature 31 is kept at a temperature greater than the low operable temperature.

Again referring to FIG. 4, the cover member 31 has a very low thermal conductivity. When the first and the second damper members 32*a* and 32*b* perfectly close the first and the second opening portions 31*a* and 31*b*, respectively, the room temperature of the cover member 31 is elevated over 30° C. in comparison with no cover member. The atmospheric temperature may lower under the predetermined low temperature. In this case, the room temperature may lower under the low operable temperature. Therefore, it is desirable to locate a heating section 41 in the cover member 31.

The heating section 41 comprises a sensor 41*a* and a heating device 41*b*. The sensor 41*a* detects the room temperature as a detected temperature. The detected temperature is supplied from the sensor 41*a* to the heating device 41*b*. Supplied with the detected temperature, the heating device 41*b* heats the room defined in the cover member 31 when the detected temperature becomes less than the predetermined low temperature.

In case where the first and the second opening portions 31*a* and 31*b* are not closed by the first and the second damper members 32*a* and 32*b*, respectively, snow may fall under an atmospheric temperature of about 0° C. In this case, snow flakes may enter in the cover member 31 from each of the first and the second opening portions 31*a* and 31*b*. Inasmuch as the room defined in the cover member 31 is heated by the radio communication device 15, the snow flakes are melted into water. The water is drained from the drain holes 11*c*.

In case where each of the first and the second opening portions 31*a* and 31*b* is not closed, the wind may blow into the cover member 31 from one of the first and the second opening portions 31*a* and 31*b*. As a result, the radio communication device 15 is strongly cooled by the wind as the wind becomes fresh. Similarly, each of the first and the second shape memory alloy springs 33*a* and 34*a* is cooled by the wind as the wind becomes fresh. The tensile strength becomes weak in each of the first and the second shape memory alloy springs 33*a* and 34*a*.

The first damper member 32*a* moves towards the right side of FIG. 4 by the tensile strength of the first spring 33*b* against the tensile strength of the first shape memory alloy spring 33*a*. In the first opening portion 31*a*, the first opening area is varied into the first variable area by the first damper member 32*a*. Namely, the first opening area gradually becomes small by the first damper member 32*a* as the wind becomes fresh. Similarly, the second opening area gradually becomes small by the second damper member 32*b* as the wind becomes fresh. As a result, the room temperature gradually rises with preventing the effect of the wind.

Even if the atmospheric temperature is high in summer, the room temperature is not elevated to the predetermined high temperature inasmuch as the room is ventilated through the first through the second opening portions 31*a* and 31*b*.

Figure 6:
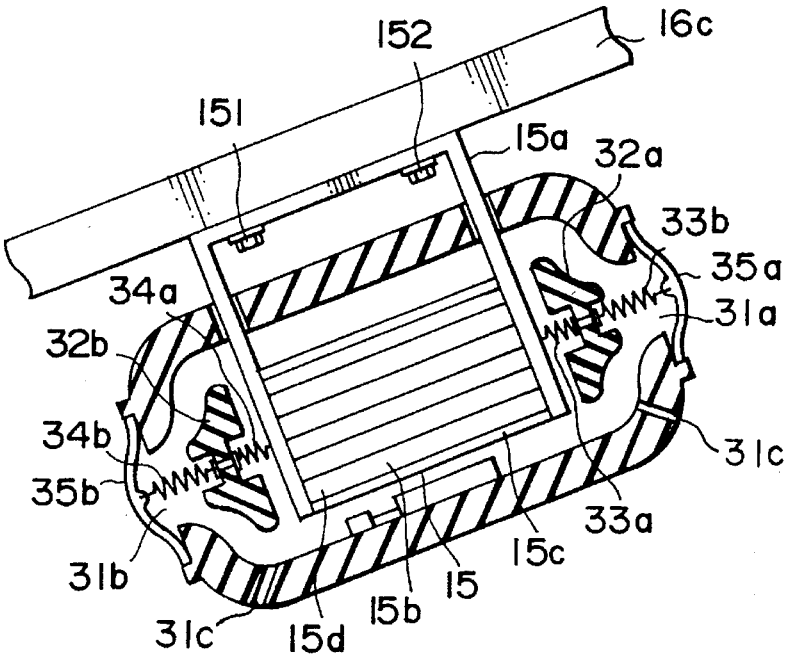
FIG. 6 shows a view for describing air flow in the protecting device illustrated in FIG. 3.

Referring to FIG. 6, the radio communication device 15 may be supported by the supporting member 16*c* with an inclination. In the example being illustrated, the radio communication device 15 is supported by the supporting member 16*c* with declining leftwardly of FIG. 6. As a result, the cover member 31 declines leftwardly of FIG. 6. The first opening portion 31*a* is positioned above the second opening portion 31*b*.

Inasmuch as the cover member 31 declines leftwardly of FIG. 6, the air in the cover member 31 moves towards the first opening portion 31*a* to be exhausted from the first opening portion 31*a* when the air in the cover member 31 is heated by the radio communication device 15. On the other hand, the outside air is introduced into the cover member 31 through the second opening portion 31*b* as the air in the cover member 31 is exhausted from the first opening portion 31*a*.

As described above, the room is naturally ventilated through the first and the second opening portions 31*a* and 31*b* when the cover member 31 has an inclination. The room is naturally ventilated through first and the second opening portions 31*a* and 31*b* even if the wind dies away. The room temperature of the cover member 31 is not elevated to the predetermined high temperature even if the wind dies away in summer.

What is claimed is:

1. A protecting device for protecting electronic equipment, said protecting device comprising:

a covering member defining a room therein for covering electronic equipment located in said room, said covering member having first and second opening portions for an air flow in a predetermined direction from said first opening portion to said second opening portion;

first damper means for varying the amount of said air flow passing through said first opening portion;

second damper means for varying the amount of said air flow by varying the amount of said air flow passing through said second opening portion;

first driving means responsive to temperature of said room for driving said first damper means to cause said first damper means to vary the amount of said air flow passing through said first opening portion; and second driving means responsive to said room temperature for driving said second damper means to cause said second damper means to vary the amount of said air flow passing through said second opening portion.

2. A protecting device as claimed in claim 1, wherein said covering member is composed of a heat insulator.

3. A protecting device as claimed in claim 2, wherein said protecting device further comprises heating means for heating said room in response to said room temperature.

4. A protecting device as claimed in claim 3, wherein said heating means comprises:

detecting means for detecting said room temperature as a detected temperature; and a heating device responsive to said detected temperature for heating said room when said detected temperature is less than a predetermined temperature.

5. A protecting device as claimed in claim 2, wherein each of said first and said second driving means comprises a temperature sensing element having a variable tensile strength in accordance with said room temperature, each of said first and said second damper means being driven on the basis of said variable tensile strength.

6. A protecting device as claimed in claim 5, wherein said temperature sensing element is a spring made of a shape memory alloy.

7. A protecting device as claimed in claim 6, wherein said shape memory alloy is composed of TiNi.

8. A protecting device as claimed in claim 6, each of said first and said second damper means having a body portion which is for use in closing each of said first and said second opening portions, said body portion having a front surface and a rear surface, said front surface facing said first opening portion in said first damper means, said front surface facing said second opening portion in said second damper means, said rear surface being opposite to said front surface in each of said first and said second damper means, wherein:

each of said first and said second driving means further comprises an additional spring which has a predetermined tensile strength independent from said room temperature;

said spring being located at a position at which said variable tensile strength is given to said rear surface in each of said first and said second damper means;

said additional spring being located at an additional position at which said predetermined tensile strength is given to said front surface in each of said first and said second damper means.

9. A protecting device as claimed in claim 8, wherein said body portion is composed of a heat insulator.

10. A protecting device for protecting electronic equipment, said protecting device comprising:

a covering member defining a room therein for covering electronic equipment located in said room, said covering member having first and second opening portions for an air flow in a predetermined direction from said first opening portion to said second opening portion;

first damper member to vary the amount of said air flow passing through said first opening portion;

second damper member to vary the amount of said air flow by varying the amount of said air flow passing through said second opening portion;

first driving device responsive to temperature of said room to drive said first damper member to cause said first damper member to vary the amount of said air flow passing through said first opening portion; and second driving device responsive to said room temperature for driving said second damper member to cause said second damper member to vary the amount of said air flow passing through said second opening portion.

* * * * *